US010559915B1

(12) United States Patent
Pahulje et al.

(10) Patent No.: US 10,559,915 B1
(45) Date of Patent: Feb. 11, 2020

(54) RUGGEDIZED ELECTRICAL RECEPTACLE

(71) Applicant: Amphenol Corporation, Wallingford, CT (US)

(72) Inventors: John M. Pahulje, Toronto (CA); Kent H. Lambie, Whitby (CA); Jun Cao, Shanghai (CN); Adrian Green, Newcastle (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 16/263,830

(22) Filed: Jan. 31, 2019

(51) Int. Cl.

| | |
|---|---|
| ***H01R 13/52*** | (2006.01) |
| ***H01R 13/6461*** | (2011.01) |
| ***H01R 13/533*** | (2006.01) |
| ***H01R 24/64*** | (2011.01) |
| ***H01R 13/717*** | (2006.01) |

(52) U.S. Cl.
CPC ..... *H01R 13/5213* (2013.01); *H01R 13/5216* (2013.01); *H01R 13/5221* (2013.01); *H01R 13/533* (2013.01); *H01R 13/6461* (2013.01); *H01R 13/7175* (2013.01); *H01R 24/64* (2013.01)

(58) Field of Classification Search
CPC ..... H01R 13/5221; H01R 13/5216; H01R 24/64; H01R 13/5219; H01R 13/533
See application file for complete search history.

(56) References Cited

U.S. PATENT DOCUMENTS

| | | | | |
|---|---|---|---|---|
| 6,139,351 | A * | 10/2000 | Schaefer | B60L 3/0069 439/372 |
| 6,379,157 | B1 | 4/2002 | Curry et al. | |
| 8,025,530 | B2 | 9/2011 | Abramov | |
| 8,096,839 | B2 | 1/2012 | Abughazaleh et al. | |
| 9,437,957 | B2 * | 9/2016 | Lee | H01R 13/5202 |
| 9,608,359 | B2 * | 3/2017 | Arai | H01R 12/716 |
| 9,634,425 | B1 * | 4/2017 | Hsu | H01R 13/5202 |
| 9,887,485 | B2 * | 2/2018 | Lambie | H01R 13/5219 |
| 9,960,522 | B2 * | 5/2018 | Tada | H01R 12/707 |
| 10,367,293 | B1 * | 7/2019 | Ono | H01R 12/724 |
| 2005/0208839 | A1 | 9/2005 | Mott | |
| 2008/0261436 | A1 * | 10/2008 | Dold | H01R 24/64 439/352 |
| 2010/0041274 | A1 | 2/2010 | Marti et al. | |
| 2011/0104933 | A1 | 5/2011 | Straka et al. | |
| 2013/0077264 | A1 | 3/2013 | Schwalst | |
| 2013/0128476 | A1 | 5/2013 | Liou | |

* cited by examiner

*Primary Examiner* — Briggitte R. Hammond
(74) *Attorney, Agent, or Firm* — Blank Rome LLP

(57) ABSTRACT

A ruggedized electrical receptacle that has a shell configured to receive an interface of a mating connector and a contact subassembly received in the shell. The contact subassembly includes a contact printed circuit board, interface contacts coupled to one face of the contact printed circuit board, termination contacts coupled to the other face thereof, and an overmold overmolded on the board. The overmold surrounds the contact printed circuit board such that free ends of the interface contacts are exposed and tail ends of the termination contacts are exposed. An internal sealing member is disposed between an outer surface of the overmold and the inner surface of the shell, thereby creating a seal therebetween.

20 Claims, 6 Drawing Sheets

RUGGEDIZED ELECTRICAL RECEPTACLE

FIELD OF THE INVENTION

The present invention relates to an electrical receptacle that has a ruggedized design for harsh environments.

BACKGROUND

Conventional electrical connectors, including data jacks and receptacles, are usually not suitable for certain applications, such as those in harsh environments, which expose the connector to damaging environmental conditions, water, extreme temperatures, vibrations, etc. As such, rugged electrical connectors were developed specifically for harsh environment applications. There is an increasing trend for today's electronic devices to be able to withstand exposure to harsh environments. Typical applications may involve exposure to dust, splashing water or cleaning solutions over the course of their lifetime. However, the known rugged electrical connectors often fail and provide only degraded performance. Enclosures need to be able to withstand these types of risks without causing damage to internal components. Application requirements are requiring more and more products to meet ever increasing levels of environmental protection. Designers must consider the influence of temperature extremes, moisture, solvents, icing, corrosion, fungus, salt exposure etc.

SUMMARY

Accordingly, the present invention may provide a ruggedized electrical receptacle that comprises a shell that includes an inner surface defining an inner receiving area having front and rear sections, and the front section is configured to receive an interface of a mating connector. A contact subassembly is received in the shell. The contact subassembly may comprise a contact printed circuit board with first and second opposing faces, a plurality of interface contacts coupled to the first face of the contact printed circuit board and a plurality of termination contacts coupled to the second face of the contact printed circuit board, and an overmold overmolded onto the contact subassembly. The overmold surrounds the contact printed circuit board such that free ends of the plurality of interface contacts are exposed and extend toward the front section of the shell for engaging the mating connector and tail ends of the plurality of termination contacts are exposed and extend toward the rear section of the shell for engagement with a main printed circuit board. An internal sealing member may be disposed between an outer surface of the overmold and the inner surface of the shell, thereby creating a seal therebetween.

In certain embodiments, the internal sealing member is a sealing gasket that extends around an outer perimeter of the overmold; the outer perimeter of the overmold has groove therein and the sealing gasket is received in the groove; the overmold is formed of high temperature glass filled nylon or the like and/or the sealing gasket is formed of silicone rubber or the like.

In some embodiments, the overmold is received in the rear section of the shell; the electrical receptacle further comprises an insulator housing positioned in the front section of the shell such that the free ends of the plurality of interface contacts extend into the insulator housing; the electrical receptacle further comprises a rear contact support coupled to a rear end of the shell such that the tail ends of the plurality of termination contacts extend through the rear contact support; the tails ends generally form a right angle; and/or the tail ends are generally straight.

In other embodiments, the electrical receptacle further comprises one or more LEDs coupled to a front side of the overmold with contact tails thereof extending through the overmold; the electrical receptacle further comprises a secondary internal sealing member disposed around the contact tails of the one or more LEDs and abutting the front side of the overmold; the secondary internal sealing member is another sealing gasket; the electrical receptacle further comprises an external sealing member positioned on an outer surface of the shell; and/or the receptacle is devoid of epoxy or adhesive.

The present invention may also provide a ruggedized electrical receptacle that comprises a shell that includes an inner receiving area that has front and rear sections. The front section is configured to receive an interface of a mating connector. A contact subassembly is received in the shell. The contact subassembly comprises a contact printed circuit board with first and second opposing faces and at least one of the first and second opposing faces having capacitive compensation circuits. A plurality of interface contacts are coupled to the first face of the contact printed circuit board and a plurality of termination contacts coupled to the second face of the contact printed circuit board. An overmold is overmolded onto the contact subassembly to surround the contact printed circuit board such that free ends of the plurality of interface contacts are exposed and extend toward the front section of the shell for engaging the mating connector and tail ends of the plurality of termination contacts are exposed and extend toward the rear section of the shell for engaging a main printed circuit board. An internal sealing member may be disposed around an outer perimeter of the overmold, thereby creating a seal therebetween between the overmold and the shell.

In one embodiments, the electrical receptacle further comprises an insulator housing positioned in the front section of the shell such that the free ends of the plurality of interface contacts extend into the insulator housing; and a rear contact support coupled to a rear end of the shell such that the tail ends of the plurality of termination contacts extend through the rear contact support. In another embodiment, the electrical receptacle further comprises one or more LEDs coupled to a front side of the overmold with contacts thereof extending through the overmold; and a secondary internal sealing member disposed around the one or more LEDs and abutting the front side of the overmold. In yet another embodiment, the electrical receptacle further comprises an external sealing member positioned on an outer surface of the shell; and each of the internal sealing member, secondary internal sealing member, and external sealing member, is a sealing gasket. In one embodiment, the receptacle is devoid of epoxy or adhesive.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION

Figure 1:
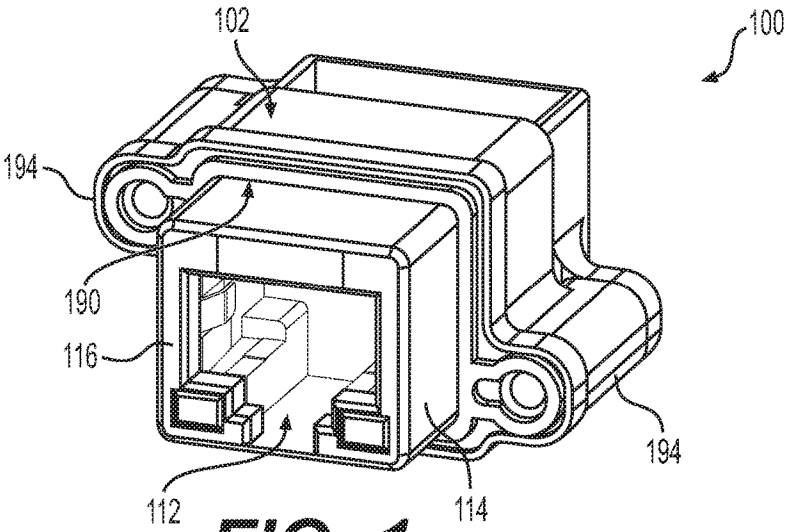
FIG. 1 is a front perspective view of a ruggedized electrical receptacle according to an exemplary embodiment of the present invention.

Referring to the figures, the present invention generally relates to an electrical receptacle 100 with a ruggedized design for harsh or demanding environment conditions, such as where Ethernet/IP protocol is used. Receptacle 100 is configured to protect against conditions such as outdoor environment, thermal and/or physical shock, humidity, vibration, salt spray, temperature rise, etc. Receptacle 100 is preferably configured to deliver IP67 protection in both mated and unmated conditions. One way to quantify an enclosure's or connector's ability to resist the elements is to reference the IEC 60529 standard. This standard defines the level of protection against intrusion of foreign objects. The format of the ratings follows a coding system where the first character after "IP" defines the solid particle protection and the second character defines the liquid ingress protection. Optional suffixes can be used to define special options. A rating of IP20 will define protection from fingers being inserted but will provide little to no protection from water or other liquid exposure. A rating of IP67 provides protection from dust as well as protection from water ingress when submerged under 1 Meter of water for 30 minutes. Receptacle 100 may be used for any number of applications, such as military vehicles and equipment, mobile communication systems, factory automation, outdoor communications, vehicle instrument, navigation and GPS systems, or security/surveillance equipment. Receptacle 100 also preferably has an epoxy or adhesive free design to protect from leakage under extreme temperature changes.

As seen in FIGS. 1-4, the ruggedized electrical receptacle 100 of the present invention generally includes a connector shell 102, a contact subassembly 104 received in the shell 102, and an internal sealing member 106, that together create an environmentally sealed connector. Receptacle 100 is configured to engage a main printed circuit board 10, as seen in FIG. 5, in either a right angle configuration (FIG. 2A) or straight configuration (FIG. 2B).

Shell 102 includes an inner surface 110 that defines an inner receiving area 112 that has a front section 114 with a front opening 116 configured to receive the interface of a mating connector or plug, such as a MRJR jack; and a rear section 118 configured to support contact subassembly 104. A locating peg 119 (FIG. 5) may be provided on the bottom of shell 102 for securing to the main printed circuit board 10. Shell 102 is preferably formed of a material that provides protection against harsh environments, such as zinc alloy or the like. An insulator 120 is located in the shell's inner receiving area 112 at its front section 114. Insulator 120 may be formed of any dielectric material, such as thermoplastic. One or more inwardly extending grounding tabs 122 may be provided in the front section 114 of shell 102 to provide a reliable ground connection between the mated receptacle 100 and jack. A rear contact support 124*a* (right angle configuration seen in FIG. 3) or 124*b* (straight configuration seen in FIG. 4) may be coupled to a rear opening 126 of the shell's rear section 118 closing in contact subassembly 104 at the rear of receptacle 100.

As seen in FIGS. 6A, 6B, 7A, and 7B, contact subassembly 104 generally includes a contact printed circuit board 130, a plurality of interface contacts 132 coupled to board 130 that are configured to engage corresponding mating contacts of the mating jack, a plurality of termination contacts 134 coupled to board 130 that are configured to engage the main printed circuit board 10, and an overmold 140 overmolded on board 130 for environmentally sealing board 130 its contact connections. Board 130 has opposing faces 136 and 138 with the interface and terminations contacts 132 and 134 being coupled to each face 136 and 138, respectively. The board's faces 136 and 138 preferably include capacitive compensation circuits 150 that electrically engage the interface and termination contacts 132 and 134. The capacitive compensation circuitry is used to shift the phase of the differential contact pairs so that they are less prone to crosstalk between the adjacent contact pairs. In a preferred embodiment, the capacitive compensation circuits 150 are designed to achieve CAT6A performance of receptacle 100.

Figure 5:
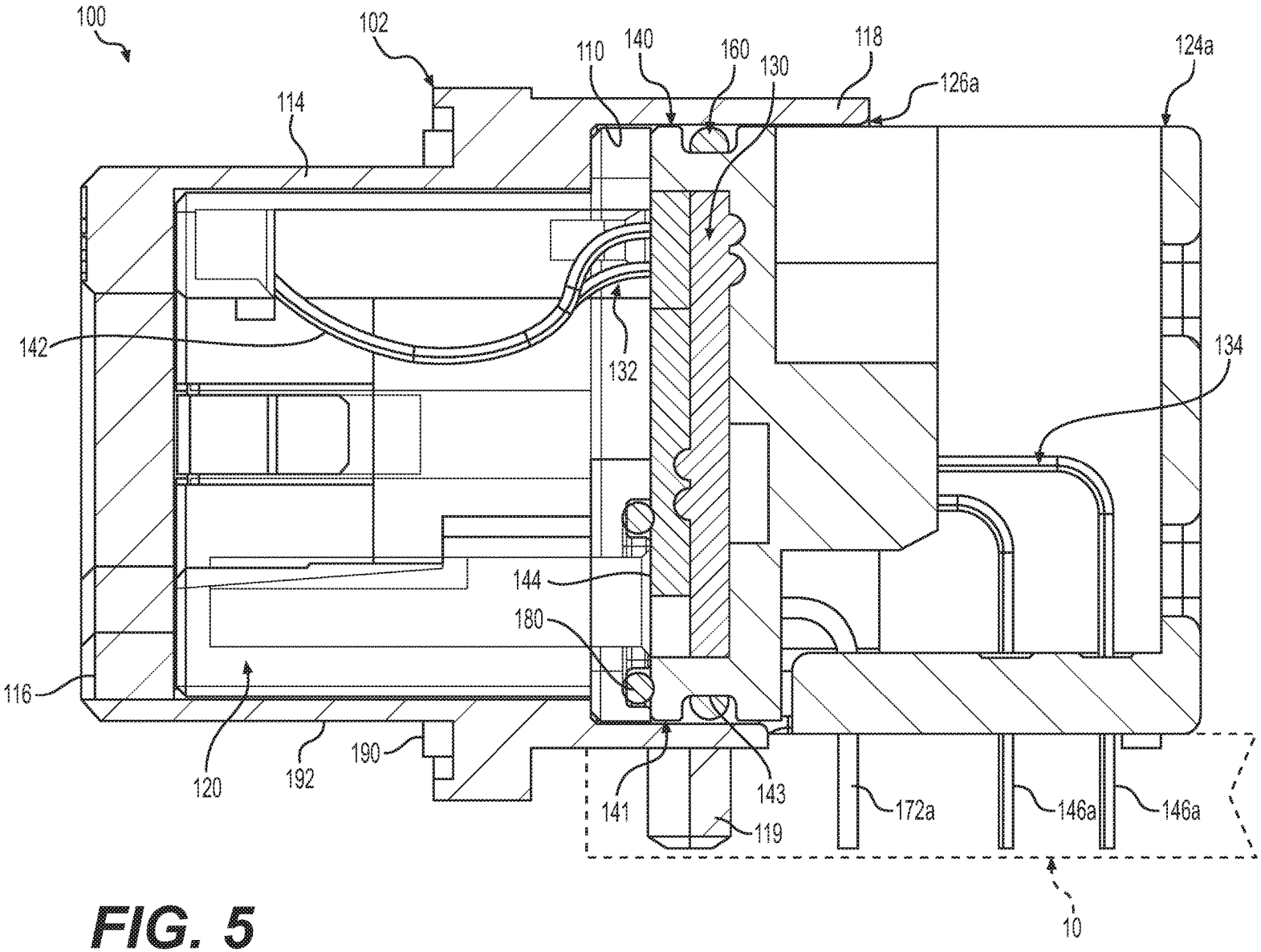
FIG. 5 is a cross-sectional view of the receptacle illustrated in FIGS. 1 and 2A.
Figure 6A:
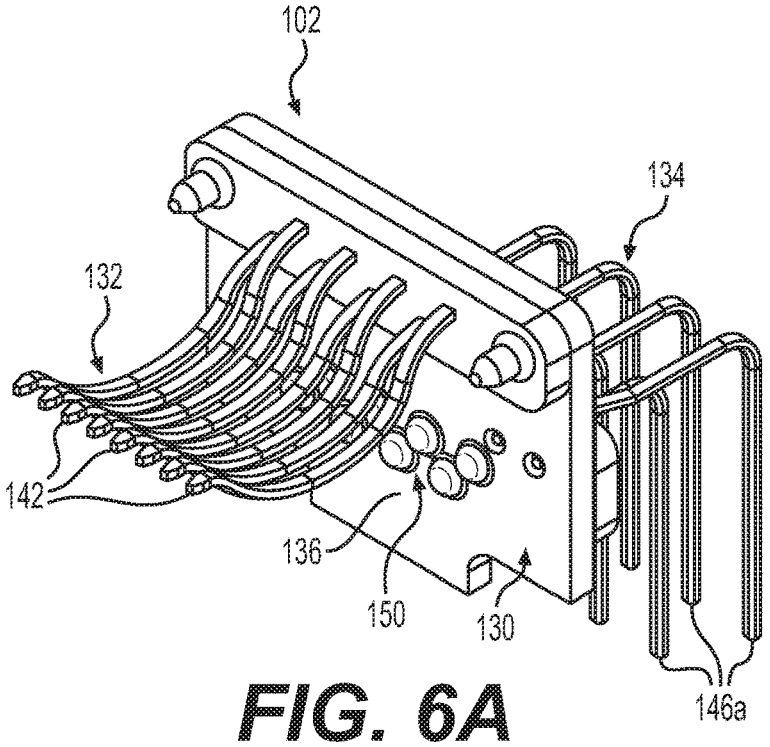
FIGS. 6A and 6B are front and rear perspective views, respectively, of a contact subassembly of the receptacle illustrated in FIGS. 1 and 2A.
Figure 6B:
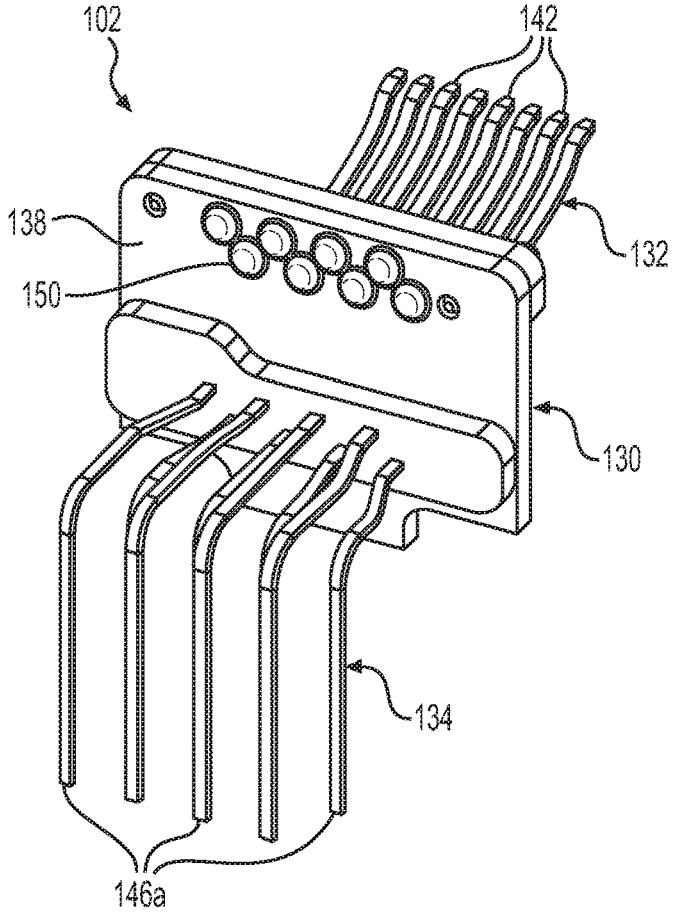
Figure 7A:
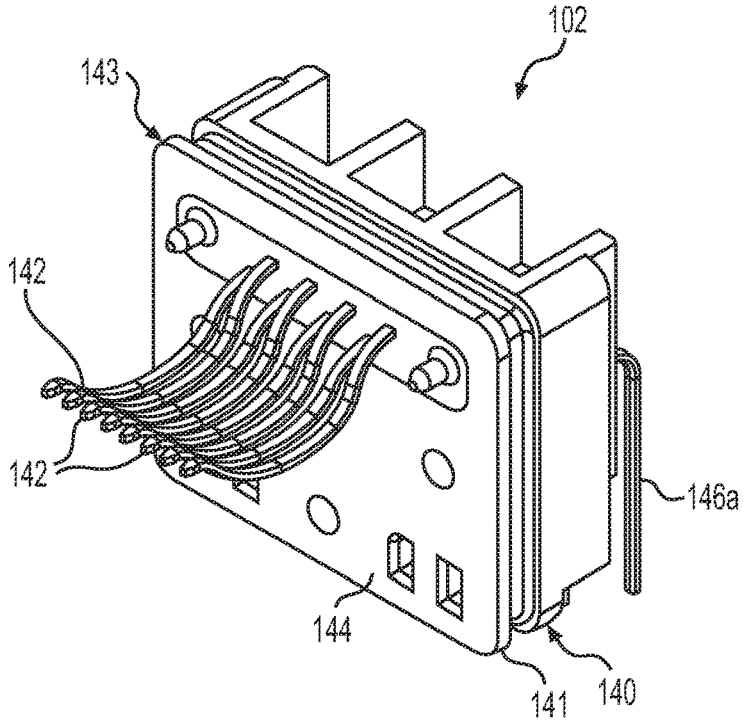
FIGS. 7A and 7B are front and rear views of the contact subassembly illustrated in FIGS. 6A and 6B, respectively, including an overmold.
Figure 7B:
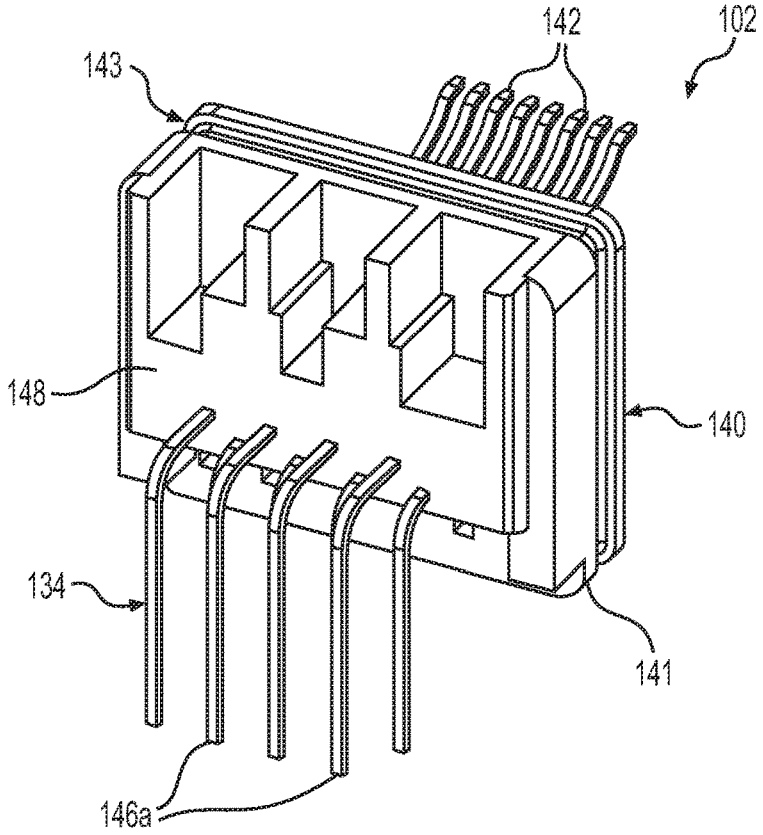

The overmold 140 surrounds the contact printed circuit board 130 such that free ends 142 of the interface contacts 132 are exposed and extend from a front side 144 (FIG. 7A) of overmold 140 toward the front section 114 of shell 102, as seen in FIG. 5, for engaging the mating jack; and tail ends 146*a* of the termination contacts 134 are exposed and extend from a rear side 148 (FIG. 7B) of overmold 140 toward the rear section 118 of shell 102 for engagement with main printed circuit board 10. Contact tail ends 146 may extend at a generally right angle through rear contact support 124*a* for engaging main board 10, as seen in FIG. 5. Alternatively, tail ends 146*b* may extend generally straight through rear contact support 124*b* for engaging main board 10. Overmold 140 is preferably made of high temperature glass filled nylon or the like.

An internal sealing member 160 may be positioned in the rear section 118 of shell 102 and around overmold 140 to provide an environmental seal therebetween. Internal sealing member 160 may be disposed between an outer perimeter 141 of the overmold 140 and the inner surface 110 of shell 102, as best seen in FIG. 5. In a preferred embodiment, the overmold's outer perimeter 141 includes a groove 143 sized to receive the sealing member 160. The internal sealing member 160 may be a gasket, which may be formed of silicone rubber or the like. The internal sealing member 160 combined with the overmold 140 of the contact subassembly 104 provides the receptacle 100 with reliable environmental sealing in harsh conditions, without the need for epoxy or adhesive, which can degrade overtime.

Figure 2B:
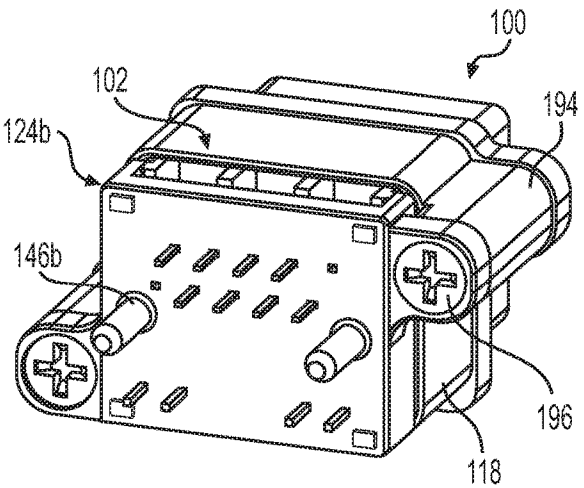
FIGS. 2A and 2B are rear perspective views of the ruggedized electrical receptacle showing two alternative configurations, right and straight, respectively.
Figure 2A:
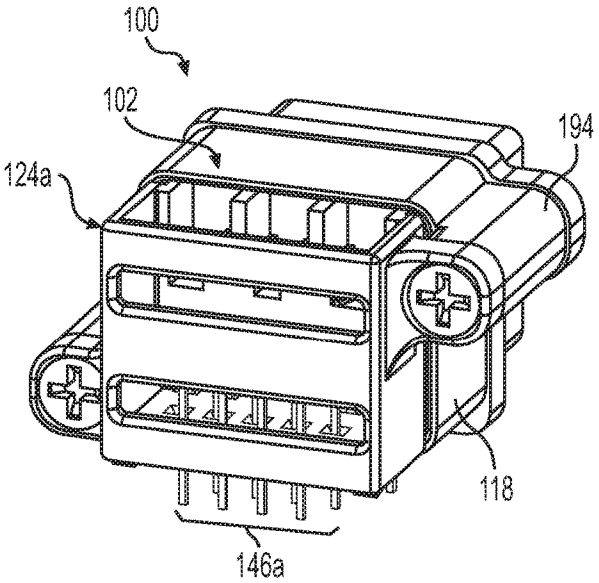
Figure 3:
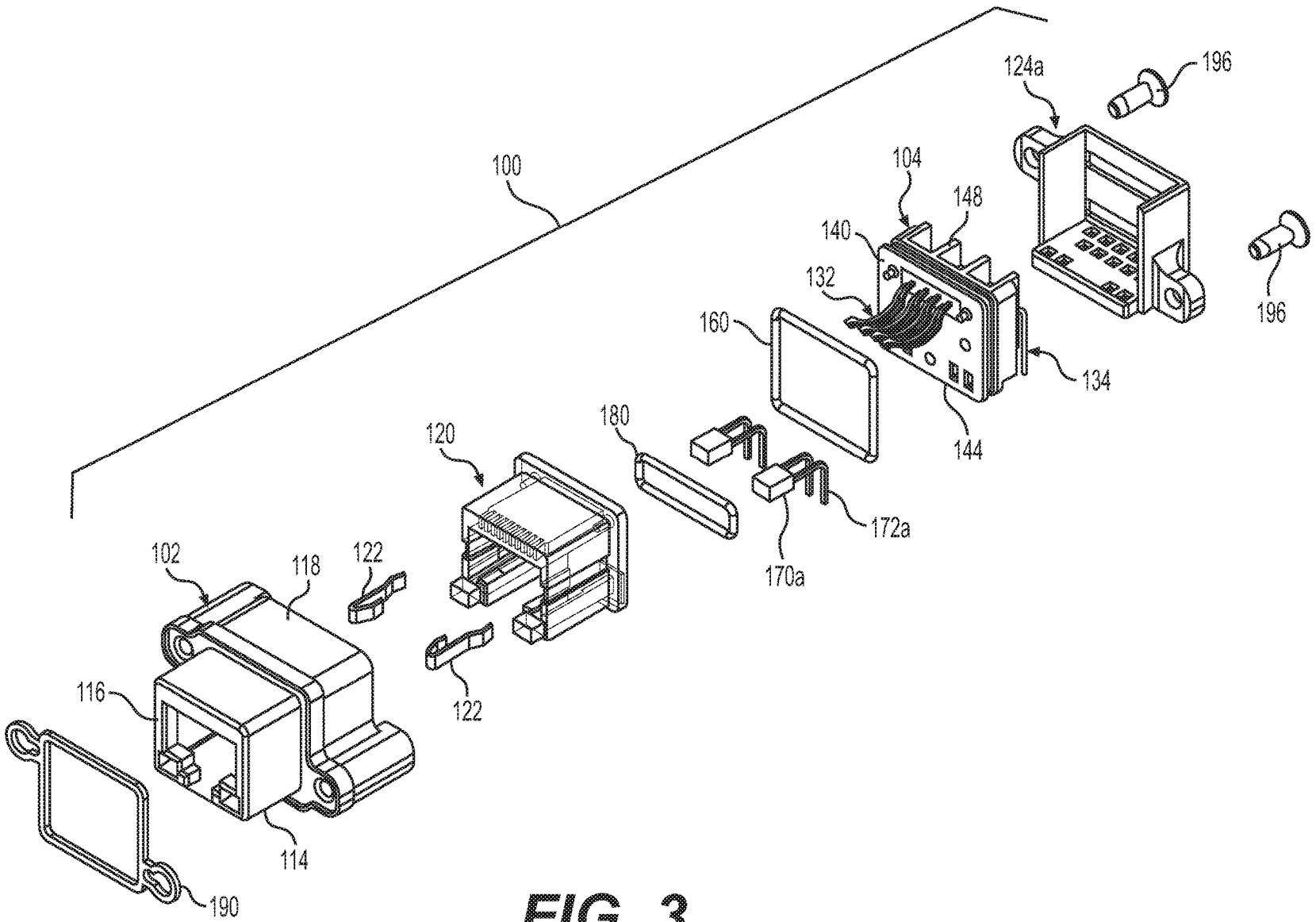
FIG. 3 is an exploded perspective view of the receptacle illustrated in FIGS. 1 and 2A.
Figure 4:
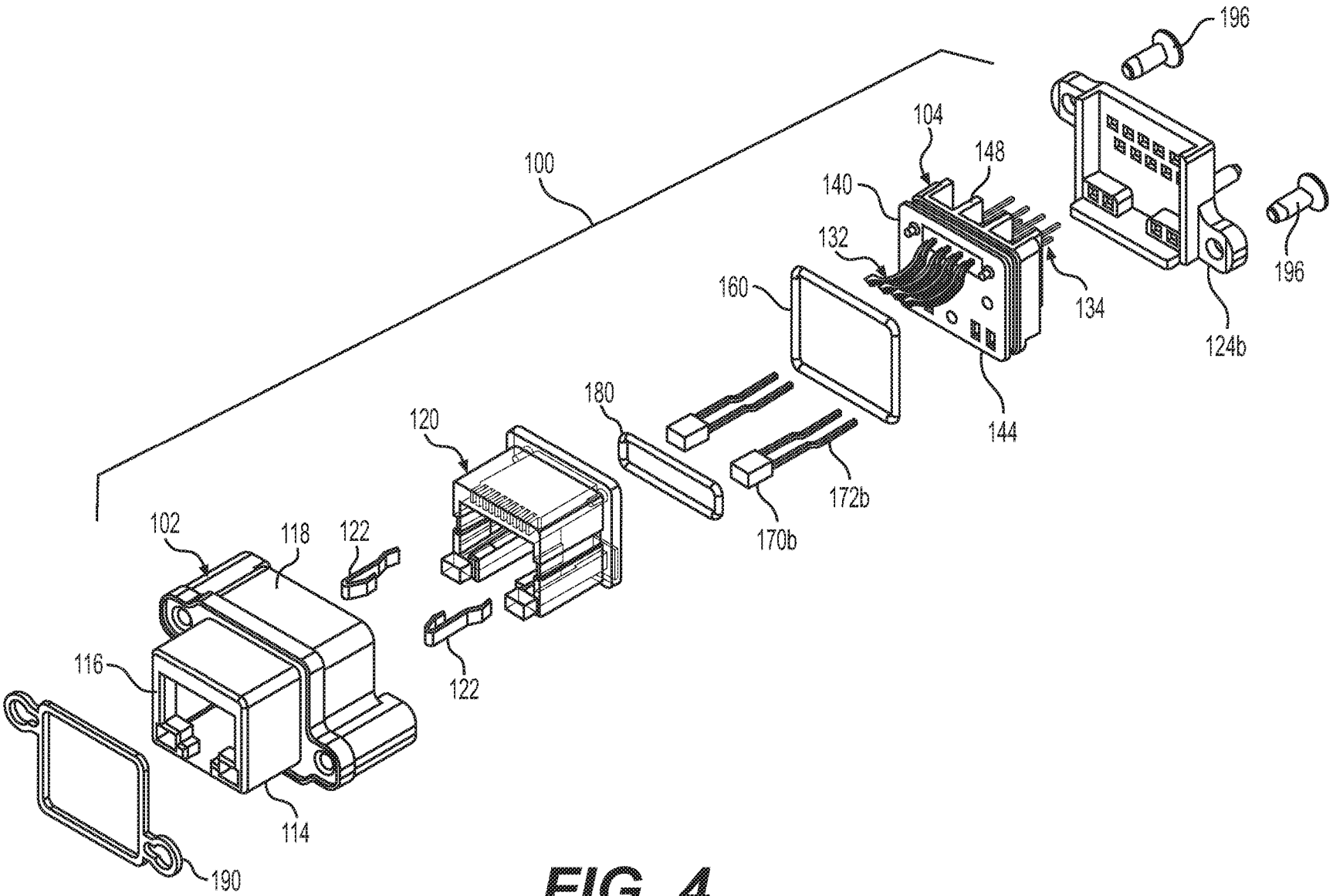
FIG. 4 is an exploded perspective view of the receptacle illustrated in FIGS. 1 and 2B.

In one embodiment, receptacle 100 includes one or more LEDS 170*a* (FIG. 3) or 170*b* (FIG. 4) mounted at the interface thereof. The LEDs 170*a* and LEDs 170*b* have rearwardly extending contact tails 172*a* and 172*b*, respectively, that extend through the overmold 140, from its front side 144 to its rear side 148. Contact tails 172*a* extend through rear contact support 124*a* at a generally right angle, as seen in FIGS. 2A and 5, for engagement with main printed circuit board 10. Contact tails 172*b* extend generally straight through rear contact support 124*b*, as seen in FIG. 2B, for engagement with main board 10. A secondary internal sealing member 180 may be provided on the front side 144 of overmold 140 for environmental sealing around the LED contact tails 172*a* or 172*b*. Secondary internal sealing member 180 may be similar to sealing member 160, except smaller, and may also be a gasket.

An outer sealing member 190 may be provided on an outer surface 192 of shell 102 adjacent to panel mounts 194 of the shell 102. Panel mounts 194 are configured to receive fasteners, such as screws 196, for coupling the rear contact support 124*a* or 124*b* to shell 102. Outer sealing member 190 may be a gasket, which may be formed of a silicone rubber or the like.

While particular embodiments have been chosen to illustrate the invention, it will be understood by those skilled in the art that various changes and modifications can be made therein without departing from the scope of the invention as defined in the appended claims.

What is claimed is:

1. A ruggedized electrical receptacle, comprising:

a shell including an inner surface defining an inner receiving area having front and rear sections, the front section being configured to receive an interface of a mating connector;

a contact subassembly received in the shell, the contact subassembly comprising, a contact printed circuit board with first and second opposing faces, a plurality of interface contacts coupled to the first face of the contact printed circuit board and a plurality of termination contacts coupled to the second face of the contact printed circuit board, and an overmold overmolded onto the contact subassembly, the overmold surrounding the contact printed circuit board such that free ends of the plurality of interface contacts are exposed and extend toward the front section of the shell for engaging the mating connector and tail ends of the plurality of termination contacts are exposed and extend toward the rear section of the shell for engagement with a main printed circuit board; and an internal sealing member disposed between an outer surface of the overmold and the inner surface of the shell, thereby creating a seal therebetween.

2. The electrical receptacle of claim 1, wherein the internal sealing member is a sealing gasket that extends around an outer perimeter of the overmold.

3. The electrical receptacle of claim 1, wherein the outer perimeter of the overmold has groove therein and the sealing gasket is received in the groove.

4. The electrical receptacle of claim 1, wherein the overmold is formed of high temperature glass filled nylon.

5. The electrical receptacle of claim 2, wherein the sealing gasket is formed of silicone rubber.

6. The electrical receptacle of claim 1, wherein the overmold is received in the rear section of the shell.

7. The electrical receptacle of claim 6, further comprising an insulator housing positioned in the front section of the shell such that the free ends of the plurality of interface contacts extend into the insulator housing.

8. The electrical receptacle of claim 7, further comprising a rear contact support coupled to a rear end of the shell such that the tail ends of the plurality of termination contacts extend through the rear contact support.

9. The electrical receptacle of claim 8, wherein the tails ends generally form a right angle.

10. The electrical receptacle of claim 8, wherein the tail ends are generally straight.

11. The electrical receptacle of claim 1, further comprising one or more LEDs coupled to a front side of the overmold with contact tails thereof extending through the overmold.

12. The electrical receptacle of claim 11, further comprising a secondary internal sealing member disposed around the contact tails of the one or more LEDs and abutting the front side of the overmold.

13. The electrical receptacle of claim 12, wherein the secondary internal sealing member is another sealing gasket.

14. The electrical receptacle of claim 1, further comprising an external sealing member positioned on an outer surface of the shell.

15. The electrical receptacle of claim 1, wherein the receptacle is devoid of epoxy or adhesive.

16. A ruggedized electrical receptacle, comprising:

a shell including an inner receiving area having front and rear sections, the front section being configured to receive an interface of a mating connector;

a contact subassembly received in the shell, the contact subassembly comprising, a contact printed circuit board with first and second opposing faces, at least one of the first and second opposing faces having capacitive compensation circuits, a plurality of interface contacts coupled to the first face of the contact printed circuit board and a plurality of termination contacts coupled to the second face of the contact printed circuit board, and an overmold overmolded onto the contact subassembly, the overmold surrounding the contact printed circuit board such that free ends of the plurality of interface contacts are exposed and extend toward the front section of the shell for engaging the mating connector and tail ends of the plurality of termination contacts are exposed and extend toward the rear section of the shell for engaging a main printed circuit board; and an internal sealing member disposed around an outer perimeter of the overmold, thereby creating a seal therebetween between the overmold and the shell.

17. The electrical receptacle of claim 16, further comprising an insulator housing positioned in the front section of the shell such that the free ends of the plurality of interface contacts extend into the insulator housing; and a rear contact support coupled to a rear end of the shell such that the tail ends of the plurality of termination contacts extend through the rear contact support.

18. The electrical receptacle of the claim 16, further comprising one or more LEDs coupled to a front side of the overmold with contacts thereof extending through the overmold; and a secondary internal sealing member disposed around the one or more LEDs and abutting the front side of the overmold.

19. The electrical receptacle of claim 18, further comprising an external sealing member positioned on an outer surface of the shell; and each of the internal sealing member, secondary internal sealing member, and external sealing member, is a sealing gasket.

20. The electrical receptacle of claim 19, wherein the receptacle is devoid of epoxy or adhesive.

* * * * *